US009376811B2

(12) United States Patent
Cipriani

(10) Patent No.: US 9,376,811 B2
(45) Date of Patent: Jun. 28, 2016

(54) BAR FOR A SUPPORT STRUCTURE FOR A FALSE CEILING AND PRODUCTION PROCESS FOR PRODUCING THE BAR

(76) Inventor: Giuseppe Cipriani, Tovereto (IT)

( * ) Notice: Subject to any disclaimer, the term of this patent is extended or adjusted under 35 U.S.C. 154(b) by 0 days.

(21) Appl. No.: 14/412,666

(22) PCT Filed: Jul. 27, 2012

(86) PCT No.: PCT/IB2012/053862

§ 371 (c)(1),
(2), (4) Date: Mar. 5, 2015

(87) PCT Pub. No.: WO2014/016648

PCT Pub. Date: Jan. 30, 2014

(65) Prior Publication Data

US 2016/0002921 A1 Jan. 7, 2016

(51) Int. Cl.
*E04B 9/06* (2006.01)

(52) U.S. Cl.
CPC ..... *E04B 9/068* (2013.01); *E04B 9/067* (2013.01)

(58) Field of Classification Search
CPC ..... E04B 9/067; E04B 9/068
USPC ..... 52/506.06, 506.07, FOR. 145, 281, 52/483.1; 29/893.33
See application file for complete search history.

(56) References Cited

U.S. PATENT DOCUMENTS 1,253,216 A * 1/1918 Day ..... E04B 9/068 52/364
3,312,488 A 4/1967 Lickliter et al.
3,321,879 A 5/1967 Purdy
3,396,997 A 8/1968 Adams
3,501,185 A 3/1970 Brown et al.
3,606,417 A 9/1971 Rousey
3,746,379 A 7/1973 Sauer
3,922,829 A 12/1975 Sauer
3,979,874 A 9/1976 Cubbler et al.
4,489,529 A 12/1984 Ollinger et al.
4,658,502 A * 4/1987 Eckold ..... B21D 39/031 29/21.1
5,271,202 A 12/1993 Vukmanic et al.
5,577,313 A * 11/1996 Guido ..... B21D 39/035 29/243.529
5,687,525 A 11/1997 Koski et al.

(Continued)

FOREIGN PATENT DOCUMENTS

AU 4226878 6/1979
DE 4431849 A1 * 3/1996 ..... B21D 39/031

(Continued)

OTHER PUBLICATIONS

PCT International Search Report mailed on Apr. 2, 2013 for PCT/IB2012/053862 filed on Jul. 27, 2012 in the name of Giuseppe Cipriani.

(Continued)

*Primary Examiner* — Joshua J Michener
*Assistant Examiner* — Babajide Demuren
(74) *Attorney, Agent, or Firm* — Steinfl & Bruno LLP

(57) ABSTRACT

A support structure for a false ceiling and a working process for working the bar are described. The bar has an elongated shape along a longitudinal direction and includes at least two sheet metal portions located side by side or overlapping, in contact or adherent, the one with the other. In the bar a transverse direction, extending transverse to, or intersecting, the longitudinal direction is defined. At least one of the sheet metal portion has cuts defining partially cut parts, wherein a partially cut part of at least one of the sheet metal portions protrudes towards the other to determine an interference of parts, and wherein the cuts are arranged, are directed, or extend along the transverse direction.

10 Claims, 12 Drawing Sheets

(56) References Cited

U.S. PATENT DOCUMENTS

| | | | | | |
|---|---|---|---|---|---|
| 5,979,055 | A * | 11/1999 | Sauer | B21D 39/035 29/897.3 |
| 6,047,511 | A * | 4/2000 | Lehane | E04B 9/068 29/521 |
| 6,138,416 | A | 10/2000 | Platt | |
| 6,523,314 | B1 | 2/2003 | LaLonde et al. | |
| 6,729,100 | B2 | 5/2004 | Koski et al. | |
| 7,762,034 | B2 | 7/2010 | Jankovec et al. | |
| 7,797,903 | B2 | 9/2010 | Lehane, Jr. et al. | |
| 8,590,248 | B2 * | 11/2013 | Lehane, Jr. | E04B 9/068 52/506.07 |
| 8,715,427 | B2 | 5/2014 | Vandeputte et al. | |
| 2003/0154686 | A1 * | 8/2003 | Platt | E04B 9/061 52/506.05 |
| 2003/0200719 | A1 | 10/2003 | Koski et al. | |
| 2006/0260246 | A1 | 11/2006 | LaLonde et al. | |
| 2007/0028554 | A1 * | 2/2007 | Ferrell | E04B 9/068 52/846 |
| 2008/0245018 | A1 | 10/2008 | Miller et al. | |
| 2010/0077687 | A1 * | 4/2010 | Jankovec | B21D 39/035 52/506.07 |
| 2013/0061550 | A1 | 3/2013 | Underkofler et al. | |
| 2015/0121800 | A1 | 5/2015 | Cipriani | |

FOREIGN PATENT DOCUMENTS

| | | | | |
|---|---|---|---|---|
| DE | 10211257 | A1 * | 9/2003 | B21D 39/035 |
| DE | EP 2532799 | A1 * | 12/2012 | E04B 9/068 |
| EP | 940514 | | 9/1999 | |
| EP | 1239095 | | 9/2002 | |
| EP | 1762663 | | 3/2007 | |
| GB | 1369234 | | 10/1974 | |
| GB | 2145752 | | 8/1983 | |
| GB | 2133819 | | 8/1984 | |
| GB | 2274080 | | 7/1994 | |
| IT | WO 2007039542 | A1 * | 4/2007 | B21D 39/035 |
| WO | 2014016648 | | 1/2014 | |

OTHER PUBLICATIONS

PCT Written Opinion mailed on Apr. 2, 2013 for PCT/IB2012/053862 filed on Jul. 27, 2012 in the name of Giuseppe Cipriani.

PCT International Preliminary Report on Patentability mailed on Dec. 12, 2014 for PCT/IB2012/053862 filed on Jul. 27, 2012 in the name of Giuseppe Cipriani.

PCT International Search Report mailed on Jul. 12, 2013 for PCT/IB2012/056221 filed on Jul. 11, 2012 in the name of Giuseppe Cipriani. 4 pages.

PCT Written Opinion mailed on Dec. 2, 2013 for PCT/IB2012/056221 filed on Jul. 11, 2012 in the name of Giuseppe Cipriani. 5 pages.

PCT International Preliminary Report on Patentability mailed on Apr. 10, 2014 for PCT/IB2012/056221 filed on Jul. 27, 2012 in the name of Giuseppe Cipriani. 36 pages.

PCT International Search Report mailed on May 13, 2014 for PCT/IB2012/058999 filed on Feb. 14, 2014 in the name of Giuseppe Cipriani. 3 pages.

PCT Written Opinion mailed on May 13, 2014 for PCT/IB2012/058999 filed on Feb. 14, 2014 in the name of Giuseppe Cipriani. 6 pages.

PCT International Preliminary Report on Patentability mailed on Apr. 29, 2015 for PCT/IB2012/058999 filed on Feb. 14, 2014 in the name of Giuseppe Cipriani. 11 pages.

PCT International Search Report mailed on May 13, 2014 for PCT/IB2012/059532 filed on Mar. 7, 2014 in the name of Giuseppe Cipriani. 4 pages.

PCT Written Opinion mailed on May 13, 2014 for PCT/IB2012/059532 filed on Mar. 7, 2014 in the name of Giuseppe Cipriani. 7 pages.

PCT International Preliminary Report on Patentability mailed on Apr. 17, 2015 for PCT/IB2012/059532 filed on Mar. 7, 2014 in the name of Giuseppe Cipriani. 16 pages.

Non-Final Office Action mailed on Feb. 23, 2015 for U.S. Appl. No. 14/354,546, filed Apr. 25, 2014 in the name of Guiseppe Cipriani. 13 pages.

Notice of Allowance mailed on Sep. 28, 2015 for U.S. Appl. No. 14/354,546, filed Apr. 25, 2014 in the name of Guiseppe Cipriani. 8 pages.

Non-Final Office Action mailed on Nov. 3, 2015 for U.S. Appl. No. 14/653,263, filed Jun. 17, 2015 in the name of Guiseppe Cipriani. 15 pages.

Non-Final Office Action mailed on Oct. 21, 2015 for U.S. Appl. No. 14/653,255, filed Jun. 17, 2015 in the name of Guiseppe Cipriani. 12 pages.

* cited by examiner

BAR FOR A SUPPORT STRUCTURE FOR A FALSE CEILING AND PRODUCTION PROCESS FOR PRODUCING THE BAR

CROSS REFERENCE TO RELATED APPLICATIONS

The present application is the US national stage of International Patent Application PCT/IB2012/053862 filed on Jul. 27, 2012.

The present disclosure refers generally to support structures, or load-bearing structures, for false ceilings, i.e. support structures for plates or panels placed underneath a regular ceiling which are connected to the ceiling by means of a so-called hanger, steel rods, a wire, bars or other coupling articles.

Support structures for false ceilings comprise a support frame intended for supporting or propping of panels or plates, wherein the support frame includes metal bars joined and crossed through a special joint to ideally form a grid, which defines a supporting plan for the panels or plates of the false ceiling.

Even more particularly, the present disclosure refers to a metal bar and a working process for the metal bar.

It is known that a metal bar for support structures for false ceilings, is an article of elongated shape having a "T"-shaped, or a "U"-shaped or "C"-shaped section, or other "T" shapes, which is obtained by folding of a sheet metal, so as to obtain an overlapping of two sheet metal portions, such as to define sheet metal portions which are adjacent and/or located side by side.

In practice, the metal bar includes at least two sheet metal portions, or walls, located side by side and overlapped along a longitudinal direction of the bar.

It is also known the need to use sheet metals for the manufacturing of metal bars that are in a material as light as possible and of reduced thickness, so as to affect as little as possible the weights and the cost of the support structure.

However, the use of lightweight materials is often incompatible with the possibility to ensure sufficient performance of mechanical resistance and stability of the metal bar on-site. In particular, it was noted that a metal bar manufactured in the manner described above, wherein two sheet metal walls are longitudinally located side by side, is subjected to torsion around a longitudinal axis when subjected to load. As can be understood, such a tendency to torsion influences negatively the mechanical performance.

At the basis of the present disclosure there is recognition by the inventor, that the tendency to torsion is mainly due to a tendency of the two sheet metal portions to slide relative to one another. Consequently, to reduce the tendency to torsion and increase the stiffness of the bar in the longitudinal direction, it was thought to block the sliding of the sheet metal parts.

Some solutions to join the two sheet metal portions could include bonding or welding. Such techniques are, however, very expensive and must be adapted from time to time to the type of bar being manufactured, i.e. to the shape, size and material of the metal bar.

The present disclosure stems from the technical problem of providing a metal bar for false ceiling and a working process for working a metal bar which allow to overcome the drawbacks mentioned above and/or to achieve other advantages or features.

Such technical problem can be solved by means of a metal bar according to independent claim 1, a support structure for a false ceiling according to claim 15 and a method according to claim 16.

Specific embodiments of the subject-matter of the present disclosure are set forth in the corresponding dependent claims.

In particular, according to some aspects of the present disclosure, to join or connect the at least two sheet metal portions, a partial cut of at least one of the sheet metal portions is made, such as to obtain half-cut parts of at least one of the two sheet metal portions wherein such half-cut parts may protrude, at least partially, towards the other of the two sheet metal portions and create an interference. In practice, at least one of the two sheet metal portions of the bar located side by side has cuts defining partially cut parts that, as a result of the cut, appear shifted towards the other sheet metal portion. In practice, the cuts are so made that a partially cut part of one of the two sheet metal portions protrudes towards the other of the sheet metal portions. In some embodiments both sheet metal portions located side by side show cuts defining partially cut parts, which protrude in the opposite direction and create interference.

Within the scope of the present disclosure, the term "half-cut" indicates a process such as to create in at least one sheet metal portion "partially cut parts", therefore partially joined to a remaining part of the bar, wherein a joining area, where the half-cut part deforms with respect to the remaining part of the bar, defines a sort of hinge line.

According to an aspect of the present disclosure, to counteract the bar torsion and to obtain a bar of satisfactory rigidity to torsion, the cuts are arranged, or extend, along a transverse direction of the bar, i.e. in a transverse direction with respect to the longitudinal direction (or long side direction), for example a short side direction. A transverse direction can be orthogonal, or oblique with respect to the bar longitudinal direction, in fact it is a direction that "crosses" or "intersects" the longitudinal direction. The transverse direction may be straight or wavy or curved.

In particular, the extension of the cuts in the transverse direction is such as to create an interference between the sheet metal portions extended in such transverse direction. As mentioned above, such interference of parts in said direction, proved to be particularly effective to prevent or reduce a torsion of the metal bar.

In some embodiments, the cuts or the parts thereof partially cut can be made in such a way that the projection towards the other of the sheet metal portions, and the relative interference, is not extended in the transverse direction over the entire height of the half-sheared part. In practice, the half-sheared part may protrude only partially towards the other sheet metal portion, for example, in correspondence of said hinge line area, or deformed area. In some embodiments, such hinge line area coincides with a corner area of the half-cut part.

In one embodiment, the cuts are made in pairs and staggered on opposite sides of the bar, so as to form pairs of partially cut and interfering parts which alternate in the longitudinal direction. In practice, in some embodiments, each of the at least two sheet metal portions have pairs of adjacent cuts. The pairs of cuts are two by two staggered in said longitudinal direction and from opposite sides. Such cuts determine an alternating shifting in opposite directions of pairs of partially cut parts. This alternating shifting allows to obtain an increased interference between the parts.

The pairs are therefore alternately shifted towards the one sheet metal portion and the other sheet metal portion. A sequence of half-cut that defines an interference line or seam line is therefore made.

In an alternative embodiment, the cuts are carried out on a same single part of the bar, therefore only on one of the two sheet metal portions, so as to form pairs of alternating successive cuts on at least one of the at least two sheet metal portions, resulting in a partial cut or a deformation of the other sheet metal portion. It follows that, in this embodiment, the pairs of cuts are alternated with areas of absence of cuts.

The seam line can be continuous or a line of stitching traits. Many seem lines may also be provided.

In one embodiment, the cuts are made so as to have a depth at least equal to half the thickness of the respective sheet metal portion.

In one embodiment, the cuts are made so as to have a depth lower than half the thickness of the respective sheet metal portion.

In a further embodiment, the cuts are made so as to have a depth greater than half the thickness of the relative sheet metal portion, and allow to have a satisfactory interference.

Other features and the operation modes of the subject-matter of the present disclosure will be made evident from the following detailed description of preferred embodiments thereof, given by way of a non-limiting example. It is clear, however, that each embodiment of the subject of the present disclosure may have one or more of the advantages listed above; in any case it is not required for each embodiment to have simultaneously all the advantages listed.

Reference will be made to the figures of the annexed drawings, wherein.

Figure 1:
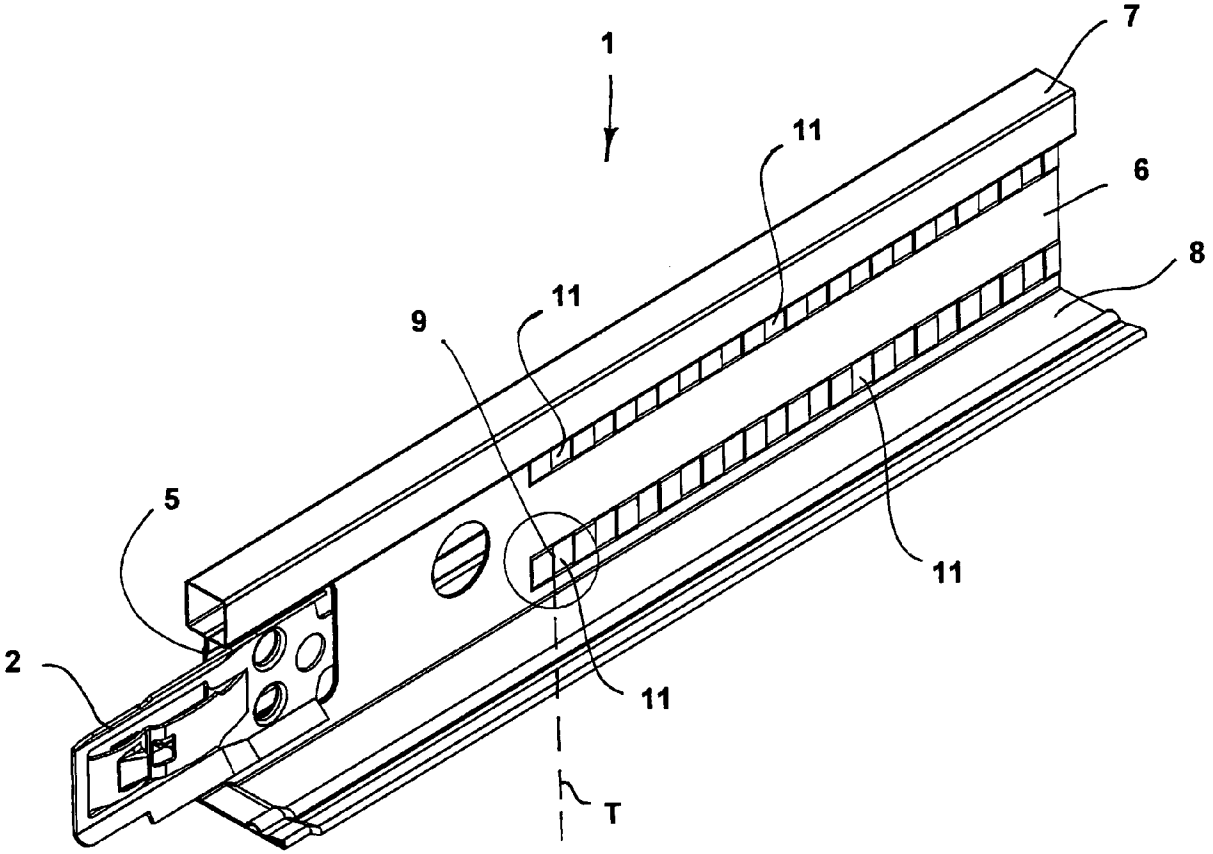
FIG. 1 shows a perspective view of a bar of a support structure for false ceilings, according to one embodiment of the present disclosure.
Figure 2:
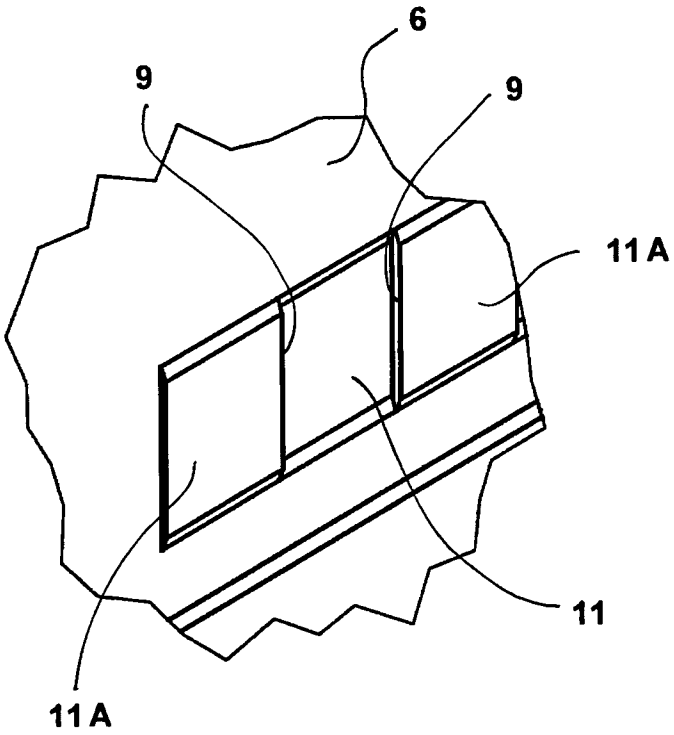
FIG. 2 shows a view of a detail II of FIG. 1.

With reference to the attached figures, a bar for making a support frame of a support structure of a false ceiling according to some embodiments of the present disclosure is denoted with the reference number 1. The bar is adapted to be joined to another metal bar 1 through a clip 2 fixed to one end of the metal bar 1. For example, more particularly, the clip 2 may be inserted into a slot (not shown) of a second metal bar 1 to be engaged with an edge that defines the slot in the metal bar 1 so as to create a join between two metal bars 1.

In the example, the metal bar 1 has a "T"-shaped section, and is obtained by folding a sheet metal, so as to obtain an overlap of at least two sheet metal portions 5, 6. The metal bar 1 may be different from the one illustrated, for example, of different section, such as for example a "C"-shaped or "U"-shaped section, or even a further different "T"-shaped section.

Figure 5:
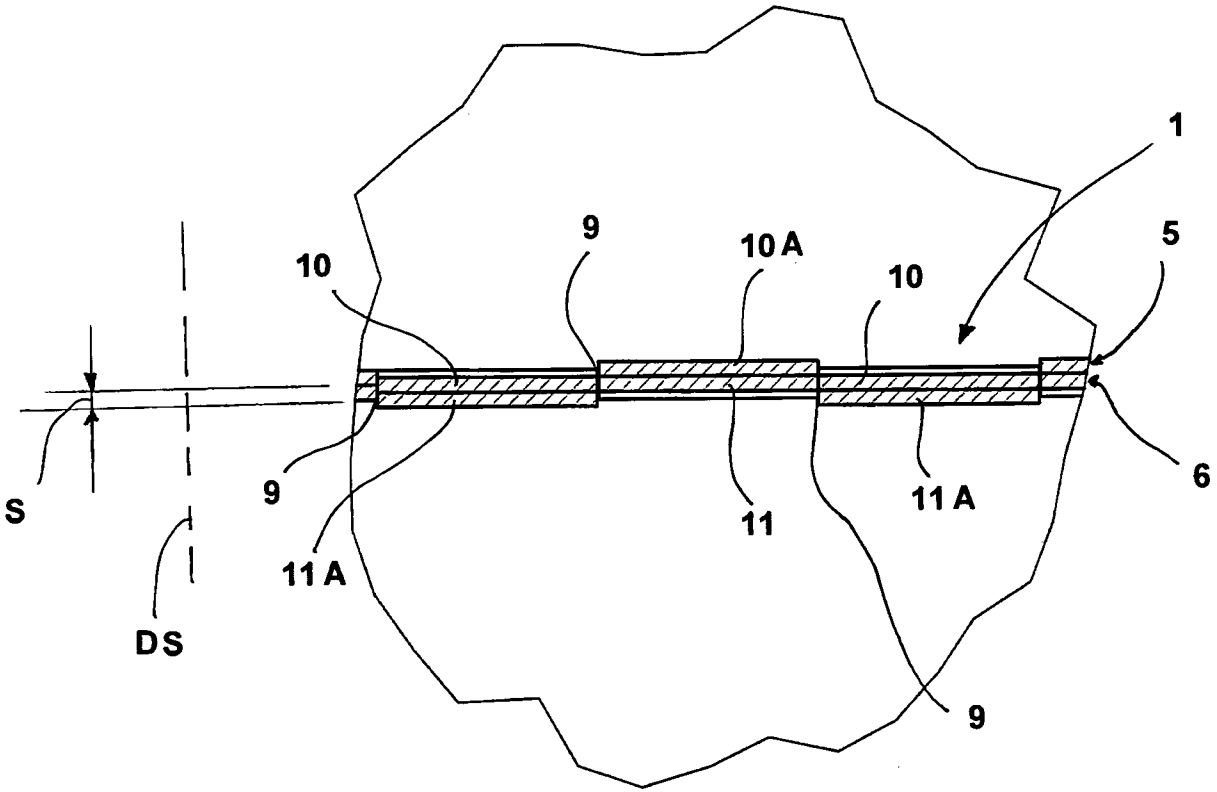
FIG. 5 shows a larger-scale view of a detail V of FIG. 4.
Figures 6, 7:
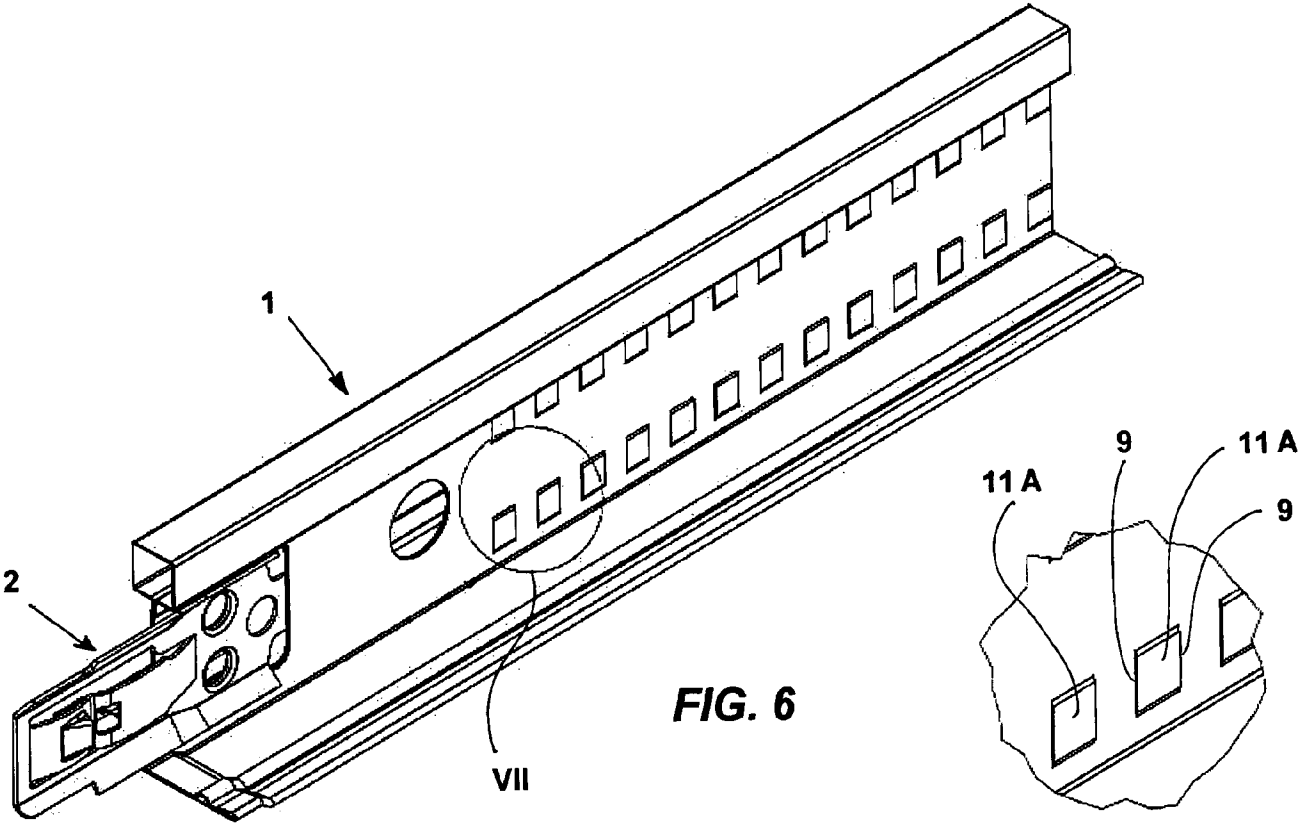
FIG. 6 shows a perspective view of a bar of a support structure for false ceilings, according to a further embodiment of the present disclosure.
FIG. 7 shows a view of a detail VII of FIG. 6.

What is important in the scope of the present disclosure is that the metal bar 1 should include at least two sheet metal portions 5, 6, or walls, located side by side and/or overlapped, as shown for example in FIG. 5. The two sheet metal portions 5, 6 may be adherent on one another.

Figure 3:
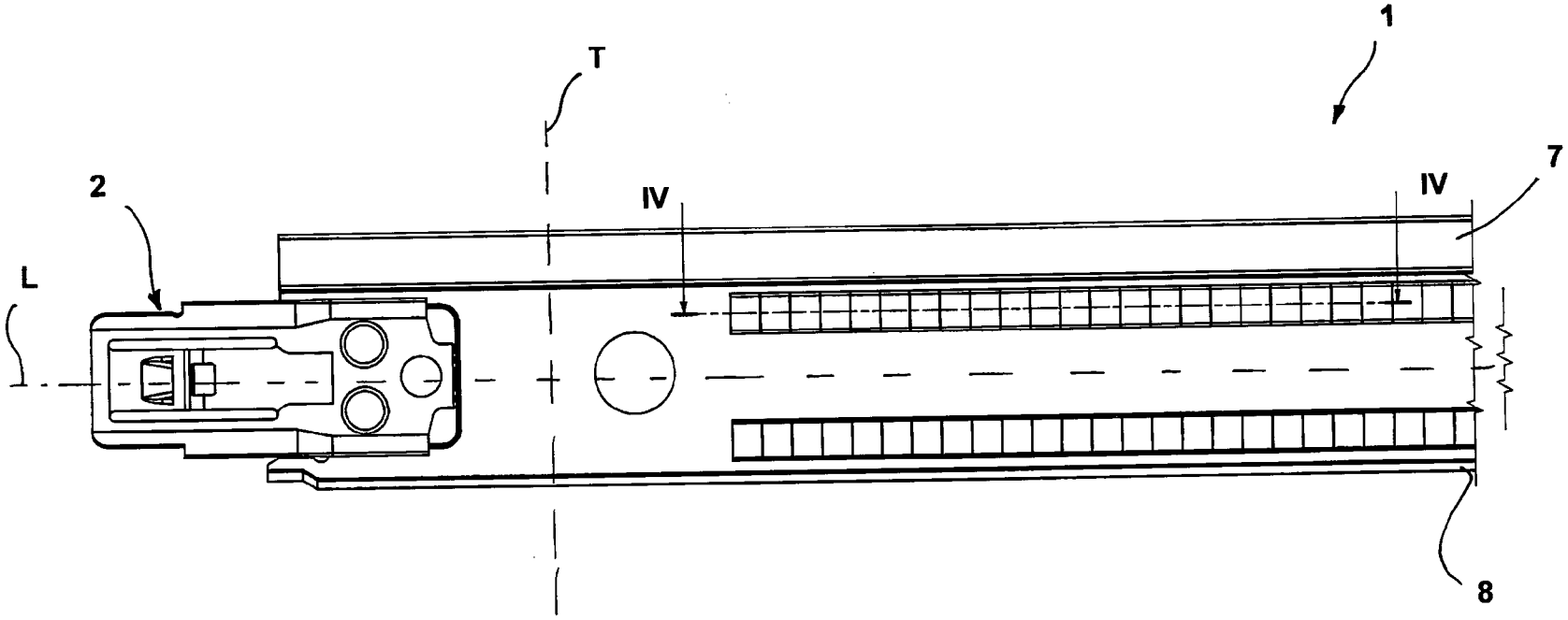
FIG. 3 shows a side view of a bar of a support structure for false ceilings, according to one embodiment of the present disclosure.
Figure 4:
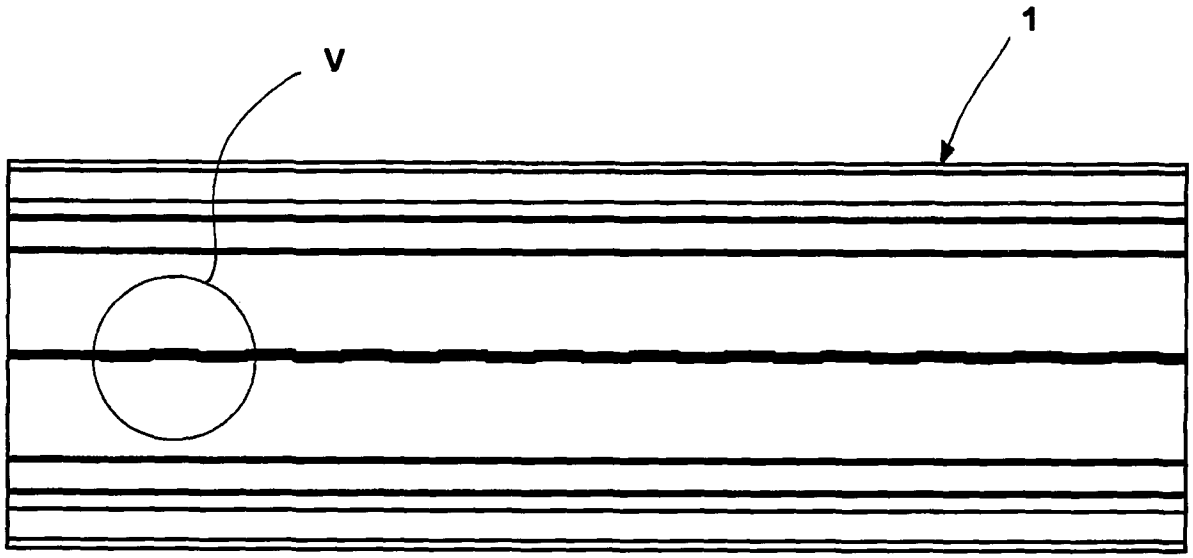
FIG. 4 shows a sectional view along the line IV-IV of FIG. 3.
Figure 8:
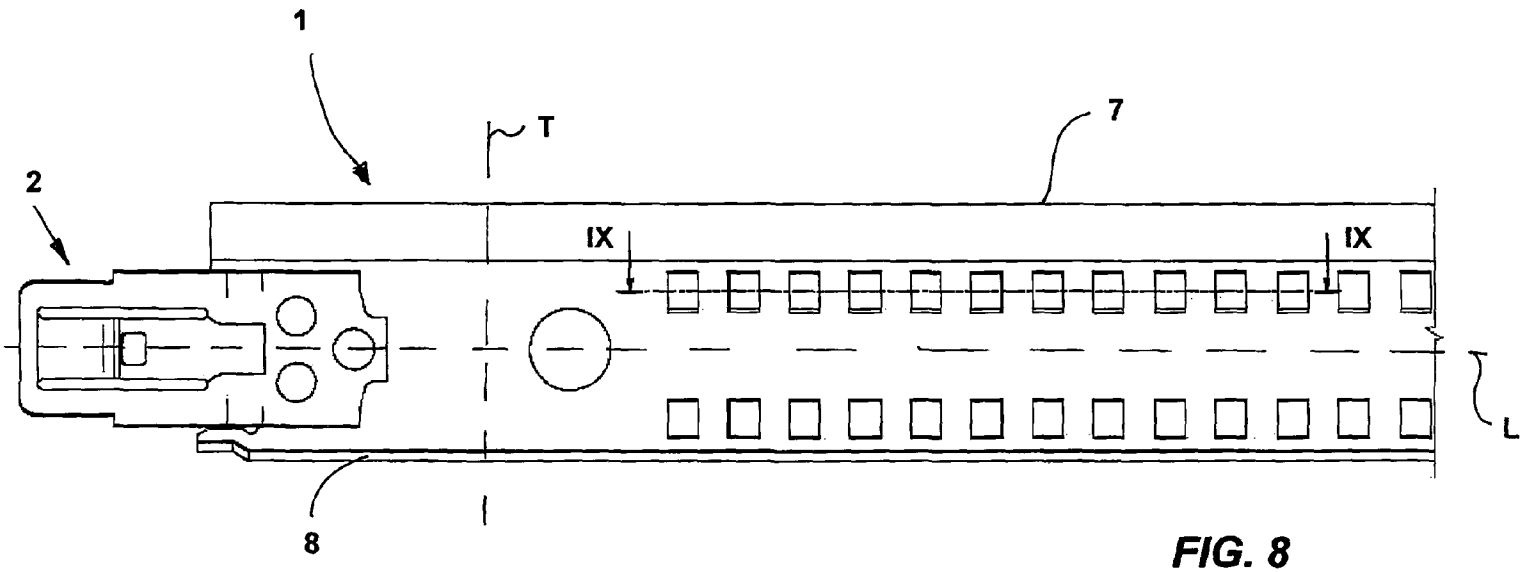
FIG. 8 shows a side view of a bar of a support structure for false ceilings, according to a further embodiment of the present disclosure.
Figure 9:
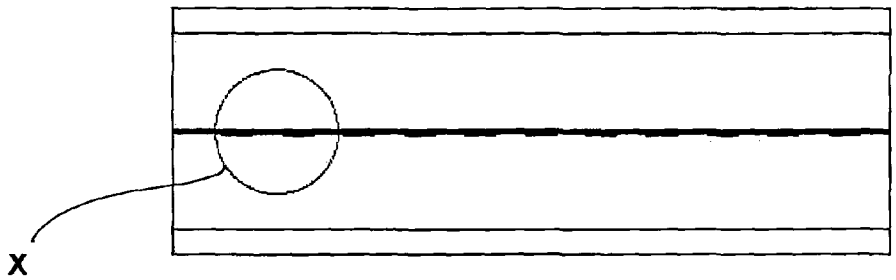
FIG. 9 shows a sectional view along the line IX-IX of FIG. 8.

The metal bar 1 extends in a prevailing direction, also called longitudinal direction, which is denoted by a dotted line in FIG. 3 and in FIG. 8, and denoted by reference letter L. In other words, the metal bar is an elongated body wherein a long side extending in said longitudinal direction and a short side, extending transversely with respect to the long side, are distinguished.

With respect to this longitudinal direction L, in the metal bar 1 it can be identified a transverse direction T (which, looking at FIGS. 3 and 8, goes from a long side to the other long side of the bar) which traverses, crosses or intersects the longitudinal direction, and which as a result goes from a base area 8 (first long side) of the metal bar 1 to a top area 7 of the metal bar 1.

Figure 17:
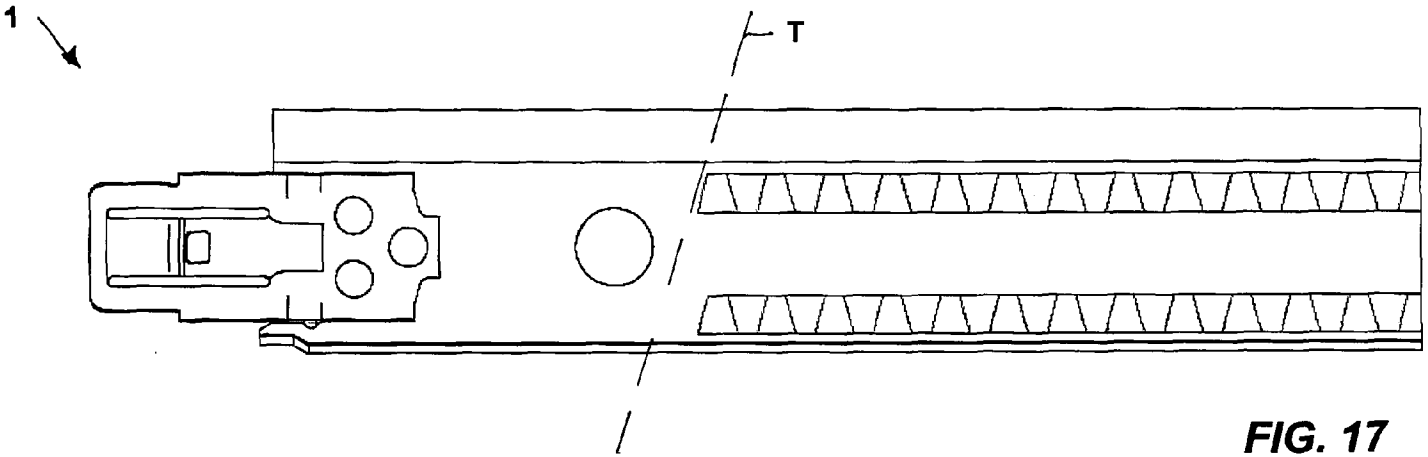
Figure 18:
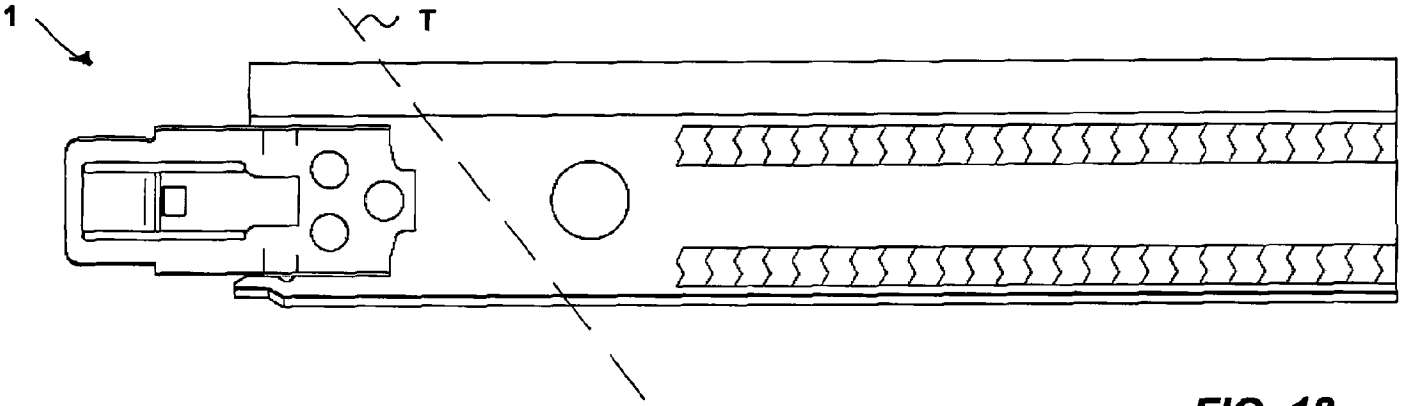
Figure 19:
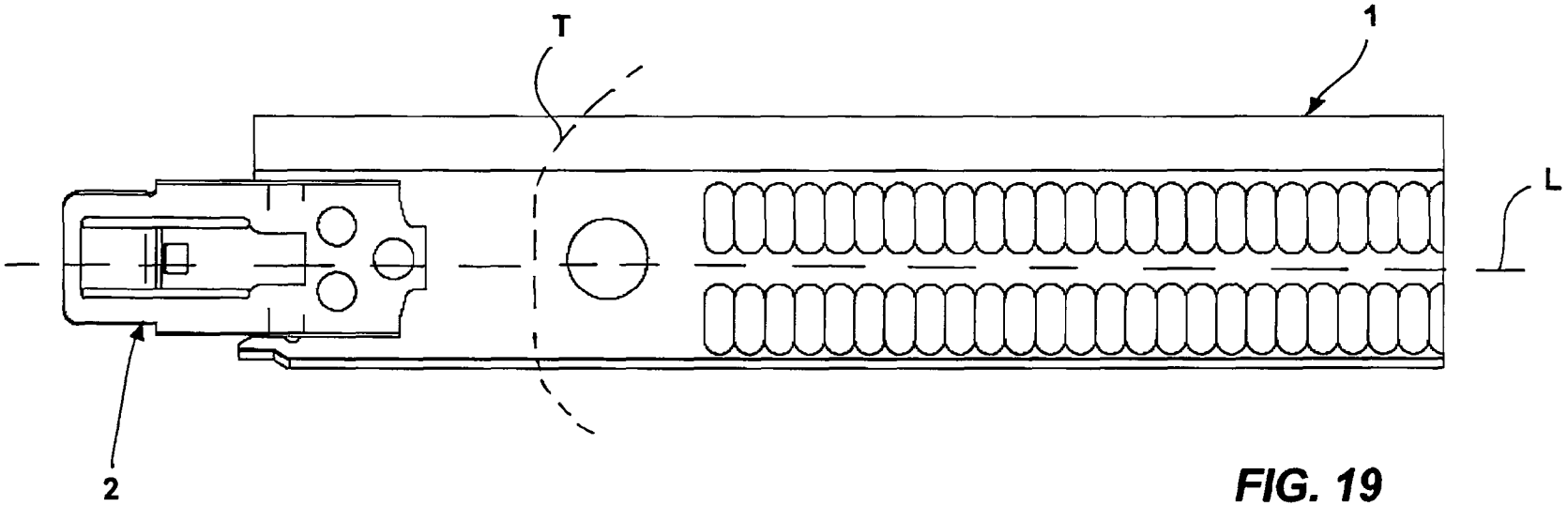

Such transverse direction T can be meant as a direction orthogonal to the longitudinal direction L, or be meant as a direction extending in an oblique way and therefore forming an acute angle with the longitudinal direction L, in a direction of the bar short side. The oblique transverse direction T is indicated in FIGS. 17 and 18. The transverse direction T can be partially curve as shown in FIG. 19, or completely curve.

According to one aspect of the present disclosure, at least one of the two sheet metal portions 5, 6 includes one or more half-cut areas, i.e. incomplete cut areas, wherein the half-cut extends in the transverse direction T of the metal bar 1. More particularly, at least one of the two sheet metal portions 5, 6 includes one or more parts 10, 10A, 11, 11A partially sheared through a partial cut i.e. by one or more cuts 9 which determines a shifting with bending of that part 10, 10A, 11, 11A of a sheet metal portion 5, 6 towards the other sheet metal portion 5, 6. Such part 10, 10A, 11, 11A of a sheet metal portion 5, 6 is shifted so as to protrude and interfere with the other sheet metal portion 5.6. In other words, the cuts 9 carried out in the transverse direction T are such as to determine a shifting or bending of the partially cut part 10, 10A, 11, 11A of at least one of the sheet metal portions 5, 6 towards the other sheet metal portion 5, 6, and a consequent projection towards the other sheet metal portion 5, 6.

It should be noted that the interference of a half-cut part towards the other sheet metal portion can occur on all the cut 9, or only in a bending zone, for example in a corner zone of the half-cut part.

In practice, one of the two sheet metal portions 5, 6 includes a part 10, 10A, 11, 11A, which being partially cut, is shifted towards the other sheet metal portion 5, 6. It follows that the partially cut part 10, 10A, 11, 11A of one of the sheet metal portions 5, 6 is able to interfere with the other sheet metal portion 5, 6, and such interference occurs, or extends, mainly in a transverse direction T.

Interference in this transverse direction T allows minimizing a possibility of torsion of the metal bar 1 around an axis parallel to the longitudinal direction L, with respect to bars of the same material and thickness of sheet metal or other characteristics of the metal bar, like elastic limit and tensile strength. In other words, the extension of the cuts 9 in the transverse direction of the metal bar 1 determines the making of half-sheared parts protruding in said transverse direction. Such half-sheared parts therefore create projections in the transverse direction and a consequent interference that is able to create an effective obstacle to a slip between the two sheet metal portions 5, 6, and consequently an effective impediment to a torsion of the bar around an axis parallel to the longitudinal direction L.

In some embodiments, such as, by way of example, the one shown in FIGS. 1-5, each of the two sheet metal portions 5, 6 comprises cuts 9 defining the partially sheared parts 10, 10A, 11, 11A, i.e. obtained through a partial cut.

In particular, each sheet metal portion 5, 6 has pairs of adjacent cuts 9, wherein each of said pairs of cuts 9 defines the part 10, 10A, 11, 11A (half-sheared or half-cut part 10, 10A, 11, 11A).

In the embodiment of FIGS. 1-5, the pairs of cuts 9 of one of the two sheet metal portions 5, 6 alternate (staggered) with respect to the pair of cuts of the other of the two sheet metal portions. In other words, the cuts 9 are made in pairs, alternatively on one side and on the other side of the bar, so as to form pairs of staggered cuts. In practice, in some embodiments, such as those illustrated, the two sheet metal portions 5, 6 have pairs of adjacent/staggered cuts in said longitudinal direction L and on opposite sides. Such cuts 9 determine an alternate shifting in opposite directions of pairs of partially cut parts, as shown in FIG. 5. This alternate shifting allows obtaining an increased interference between the parts.

It follows that, with reference to FIG. 5, according to some aspects of the present disclosure, each of said sheet metal portions 5, 6 has a thickness S such that a direction crossing the thickness S is a thickness direction DS. The partially cut parts 10, 10A, 11, 11A of FIG. 5 are overlapped in said thickness direction DS and are shifted in pairs in the thickness direction DS with respect to an adjacent area of the respective sheet metal portion 5, 6. In particular, the partially cut parts 10, 10A, 11, 11A are shifted in pairs in the thickness direction DS and one of the partially shifted parts 10A, 11A is protruding towards the outside with respect to said thickness S and defines a free area in said thickness S. The other of said partially cut parts 10, 11 is arranged at least partially in the free area of the thickness S of the one sheet metal portion 5, 6, so as to create the interference in the longitudinal direction and in the transverse direction. Such interference allows obtaining a satisfactory locking to torsion.

It may be noted that, in the exemplary embodiment of FIG. 5, the pairs of parts 10, 11A and 11, 10A follow one another adjacent without interruption in the bar 1.

In some embodiments, such as, by way of example, the one illustrated in FIGS. 6-10, only one of the two sheet metal portions 5, 6 includes the cuts 9 defining the partially cut parts 10 (sheared through a partial cut) which determine a shifting and possible cut of a corresponding part 11A of the other sheet metal portion.

In particular, a single sheet metal portion 5, 6 has one or more, for example pairs of adjacent cuts 9, wherein each of said pairs of cuts 9 defines pairs of parts 10, 11A. In the exemplary embodiment, the pairs of cuts 9 of one of the two sheet metal portions 5, 6 are made at intervals along the longitudinal direction at a constant pitch, or with determinate pitch, so as to define a plurality of pairs of cuts 9 In practice, it can be noted that the pairs of parts 10, 11A follow one another spaced at regular intervals. For the geometry of the parts described above, the pairs of parts 10, 11A alternate to parts 110, 111 of the two sheet metal portions 5, 6 which are not cut, i.e. not subjected to working.

Figure 10:
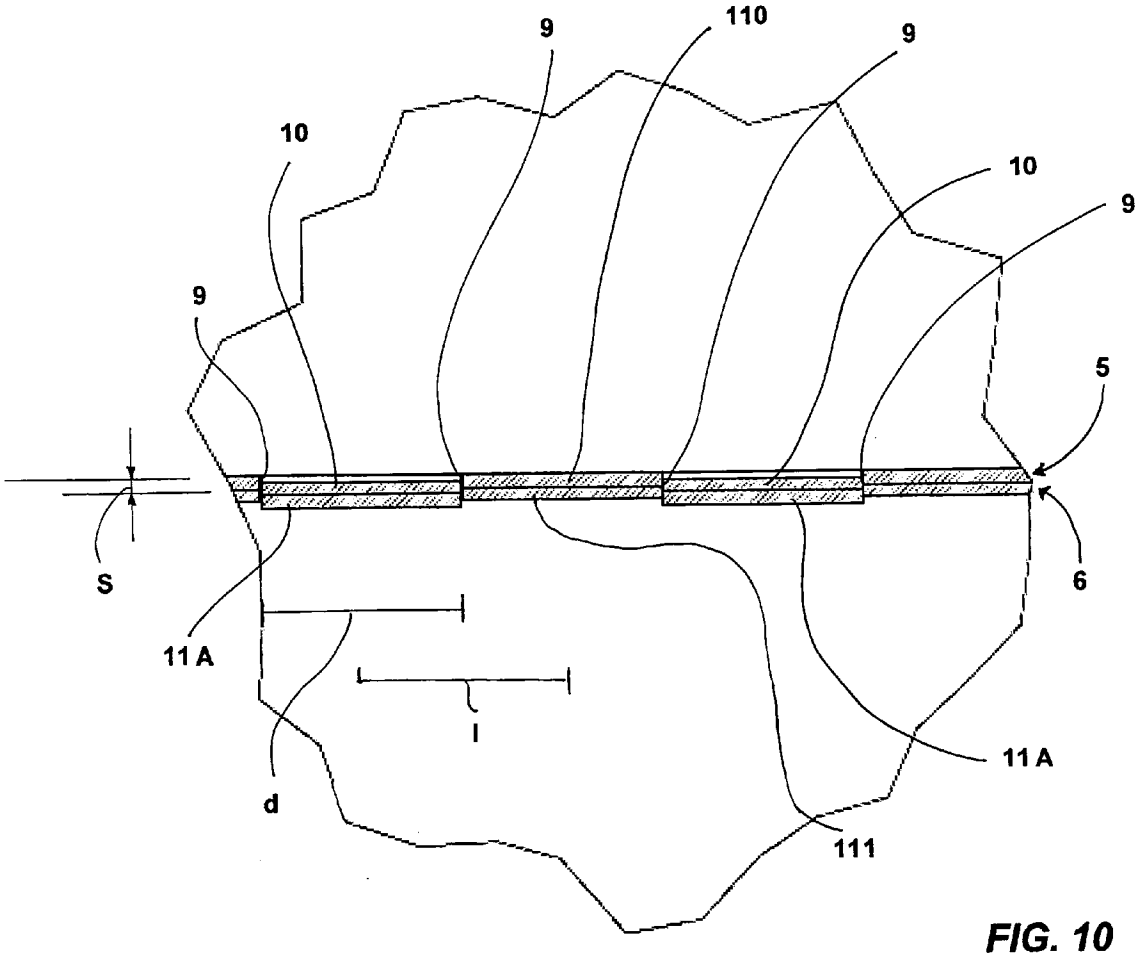
FIG. 10 shows a view in enlarged scale of a detail V of FIG. 4.

The spacing between subsequent pairs 10, 110, 11A, 111, denoted with I in FIG. 10 corresponds, for example, to the mutual distance between the two cuts 9 of each pair. In other words, pairs of cuts 9 are made only on one side of the bar, at more or less regular intervals. In this embodiment, the cuts 9 determine a shift in the same direction of the parts 10, 11A.

It follows that, with reference to FIG. 10, according to some aspects of the present disclosure, each of said sheet metal portions 5, 6 has a thickness S such that a direction crossing the thickness S is a thickness direction DS. The partially cut parts 10, 11A of FIG. 10 are overlapped in said thickness direction DS and are shifted in pairs in the thickness direction DS with respect to an adjacent area of the respective sheet metal portion 5, 6. In particular, the partially cut parts 10, 11A are shifted in pairs in the thickness direction S and one of the partially shifted parts 11A is protruding towards the outside with respect to said thickness S and defines a free area in said thickness S. The other of said parts 10 is arranged at least partially in the free area of the thickness S, so as to create interference between the sheet metal portions 5, 6.

In other embodiments, not shown in the drawings, it is also possible to provide a combination of the two former embodiments, wherein the pairs of cuts 9 may be made at intervals along the longitudinal direction at a constant pitch, or with determinate pitch, as in the embodiment of FIG. 10 and, at the same time, alternatively on the one and on the other sheet metal portion 5, 6 as in the embodiment of FIG. 5.

It follows that, in some embodiments such as those illustrated, the cuts 9 define a sequence or series of half-cut parts 10, 10A, 11, 11A, which alternate continuously or at intervals, so as to make a half-cut line. Such half-cut line is also called, in the field of bars, seam line or seam.

Figure 14:
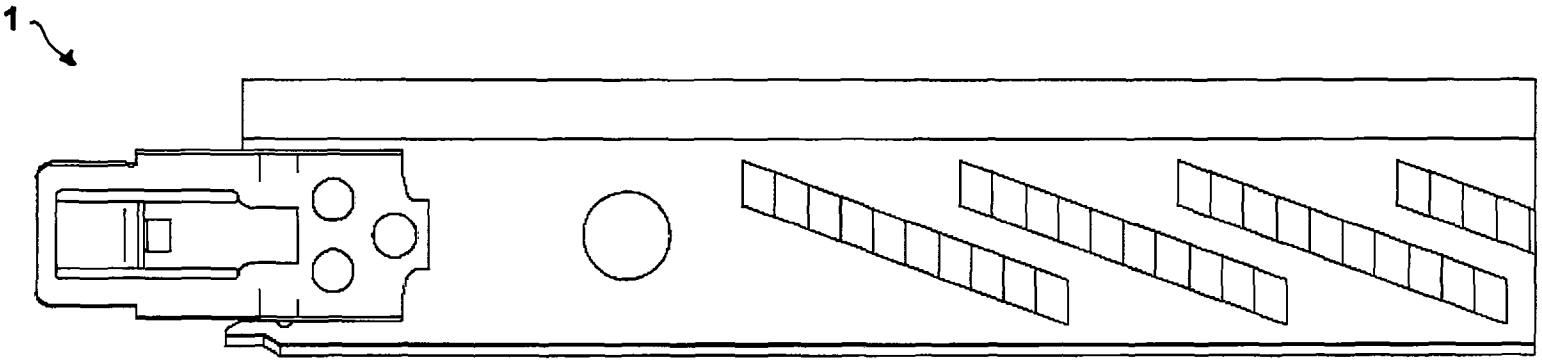
FIGS. 14-19 show respective perspective views of bars for a support structure for false ceilings, according to further embodiment of the present disclosure.
Figure 15:
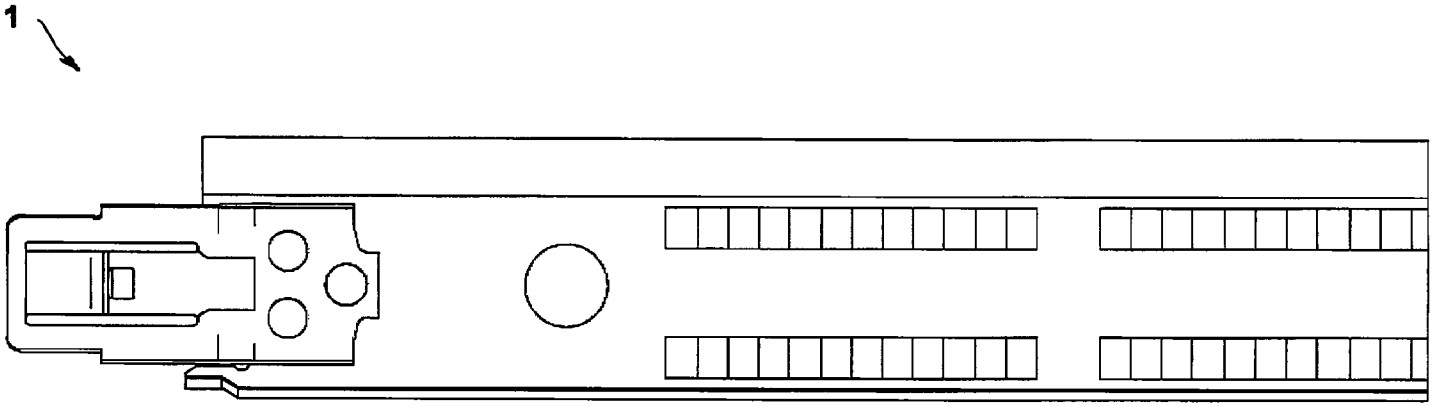
Figure 16:
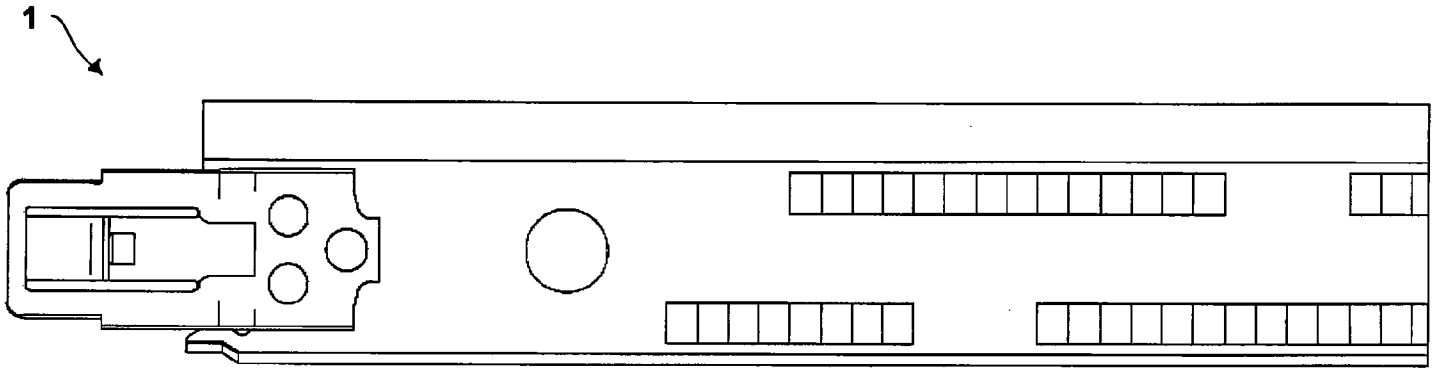

The seam line 15 or half-cut line can be in turn continues, as shown in FIG. 1, FIG. 6, FIG. 17, FIG. 18 or FIG. 19, or it can be a broken line, or a dotted line, as shown in FIG. 14, FIG. 15 or FIG. 16.

Furthermore, according to further aspects of the present disclosure as the one illustrated, the metal bar 1 may include two or more series or half-cut lines 15 arranged on two different levels in said transverse direction, comprised between the base area 8 and the top area 7, as shown by way of example in FIG. 14, FIG. 15 or FIG. 16.

Even more in particular in order to regulate and control a degree of interference between the first sheet metal portion 5 and the second sheet metal portion 6 it is possible, for each of the embodiments of the present disclosure such as those described above or a combination thereof, to adjust the depth of cut 9 with respect to the thickness S or height of the sheet metal portion 5, 6 of the bar.

Figure 11:
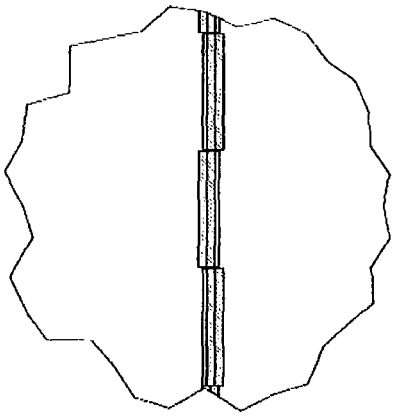

For example, in the embodiment of FIG. 5 or in the embodiment of FIG. 11, each cut 9 extends to a depth that is lower or equal to half the thickness S of the sheet metal portion 5, 6.

Figure 12:
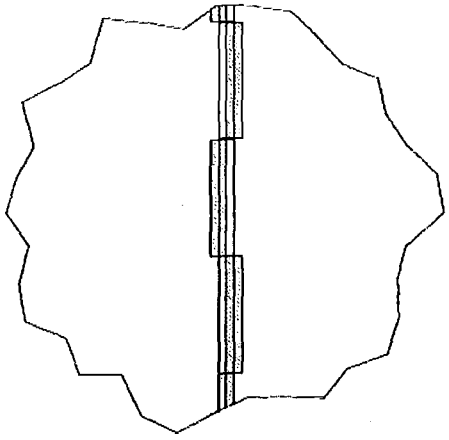

For example, in the embodiment of FIG. 12 each cut 9 extends to a depth that is equal to the thickness S of the sheet metal portion 5, 6.

Figure 13:
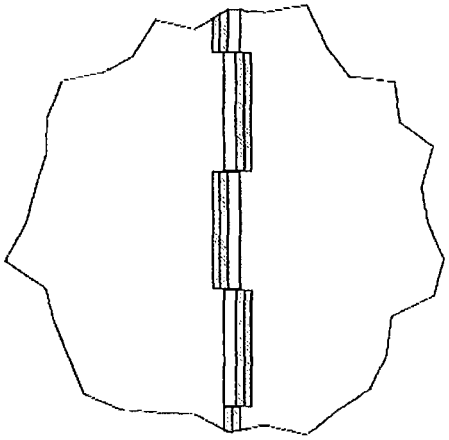
FIGS. 11-13 show sectional views of a bar according to as many embodiments of the present disclosure.

For example, in the embodiment of FIG. 13 each cut 9 extends to a depth which is greater than the thickness S of the sheet metal portion 5, 6.

It is to be understood that the depth or penetration of the cut 9 with respect to the thickness is chosen according to the interference capacity (and therefore the ability of locking in torsion) between the two sheet metal portions 5, 6 to be obtained, and depends on the thickness of each sheet metal portion 5, 6, on the material of the sheet metal portion 5, 6, on its elastic limit and on its tensile strength, or on the presence of possible surface processing present on the faces of the sheet metal portions 5, 6.

A working process for working a metal bar 1 according to an exemplary embodiment of the present disclosure is illustrated below. Such process may be used to make any of the bars described above.

A metal bar 1 is provided having for example a T-shaped section or another section and obtained by bending a sheet metal, so as to have a pair of portions or sheet metal walls 5, 6 overlapped.

One, both, or more, portions or sheet metal walls 5, 6 are subjected to partial cut by means of a device known to a person skilled in the art, suitable for making partial cut of sheet metal.

The partial cut is performed so as to make staggered pairs of cuts 9 on opposite sides of the two sheet metal portions 5, on the one of the two portions of sheet metal 5, 6 towards the other of the two portions of sheet metal 5, 6, such as those visible in FIG. 5, or pairs of cuts 9 at regular distances as those of FIG. 10 on only one of the two sheet metal portions 5, 6, or pairs of cuts as in any one of the embodiments of FIGS. 14-19. These cuts 9 extend, i.e. are directed, in the transverse direction T of the metal bar 1.

More particularly, the half-cut is made so as to define pairs of half-cut parts 10, 10A, 11, 11A, which in the exemplary embodiment of FIG. 5 alternate continuously in the longitudinal direction and pairs of parts 10, 11A which in the exemplary embodiment of FIG. 10 are arranged at regular intervals in the longitudinal direction. Thanks to the half-cut in the transverse direction it is determined an intersection in the transverse direction and in the longitudinal direction between the two sheet metal portions 5, 6 which prevents a sliding between them.

It is to be noted that the shape, or profile, of the parts 10, 10A, 11, 11A is not to be considered essential to the present disclosure. Many shapes or different profiles of half-sheared parts can be provided, as shown in FIGS. 14-19. It is important that the half-cut is performed to art avoiding that any play resulting from the manufacturing are very much reduced, and an interference between the parts is assured.

The subject-matter of the present disclosure has hereto been described with reference to preferred embodiments thereof. It is understood that there may be other embodiments referable to the same inventive concept, all falling within the protective scope of the claims set forth hereinafter.

The invention claimed is:

1. A metal bar for a support structure of a false ceiling, said bar being elongated in a longitudinal direction and including at least two sheet metal portions located side by side or overlapping, in contact, or adherent, the one with the other along said longitudinal direction, wherein a transverse direction, extending transverse to, or intersecting, said longitudinal direction, is defined in said bar, wherein each of said sheet metal portions has a sheet thickness and a thickness direction, wherein both the at least two sheet metal portions have cuts that are arranged, are directed, or extend, along said transverse direction, said cuts defining between them partially cut parts, a partially cut part of one of the sheet metal portions protruding toward the other of said sheet metal portions to determine an interference of parts, wherein pairs of partially cut parts of the two sheet metal portions are overlapped and are shifted in pairs along the thickness direction with respect to an adjacent area of the respective sheet metal portions;

wherein, of each pair of shifted partially cut parts, one partially cut part of one sheet metal portion is projecting outwards with respect to said sheet thickness and defines a free region in said sheet thickness of the one sheet metal portion, and the other partially cut part of the other of said sheet metal portions is arranged at least partially in said free region of the thickness of the one sheet metal portion creating an interference between the two sheet metal portions in the transverse direction and wherein longitudinally adjacent pairs of overlapped partially cut parts are present and are alternatively shifting in opposite directions to alternatively protrude along the longitudinal direction from one sheet metal portion and from the other sheet metal portion, and wherein a plurality of said cuts are located directly side by side to define a portion of a seam line such that gaps are absent between the partially cut parts.

2. The metal bar according to claim 1, wherein the bar includes a plurality of portions of seam line each including said plurality of partially cut parts, the portions of seam line being spaced apart, at intervals, from each other along the longitudinal direction.

3. The metal bar according to claim 2, wherein intact parts of the sheet metal portions are interposed between the partially cut parts.

4. The metal bar according to claim 1, wherein said cuts are arranged in groups spaced apart, to form a line of stitching traits.

5. The metal bar according to claim 1, wherein the seam line is a continuous seam line.

6. The metal bar according to claim 4, wherein said seam line extends along said longitudinal direction.

7. The metal bar according to claim 1, comprising a single sheet metal folded on itself to define overlapping walls, wherein said two sheet metal portions are the walls of said sheet metal.

8. The metal bar according to claim 1, wherein said metal bar is "T"-shaped.

9. The support structure for a false ceiling including the metal bar according to claim 1.

10. A working process of producing a metal bar for a support structure of a false ceiling, comprising the steps of providing said bar being elongated in a longitudinal direction and including at least two sheet metal portions located side by side and in contact with each other along said longitudinal direction, providing a portion extending transverse to and intersecting with said longitudinal direction to define said bar, wherein each of said sheet metal portions having a sheet thickness and a thickness direction, providing a step of cutting at least partially said at least two sheet metal portions in a transverse direction with respect to, and intersecting, said longitudinal direction, to define two partially cut parts according to said transverse direction, said partially cut parts of one of the sheet metal portions protruding toward the other of said sheet metal portions to define an interference of parts, wherein pairs of partially cut parts of the two sheet metal portions overlap and shift in pairs along the thickness direction with respect to an adjacent area of the respective sheet metal portions; wherein, of each pair of shifted partially cut parts, one partially cut part of one sheet metal portion is projecting outwards with respect to said sheet thickness defining a free region in said sheet thickness of the one sheet metal portion, arranging at least partially the other partially cut part of the other of said sheet metal portions in said free region of the thickness of the one sheet metal portion to create an interference between the two sheet metal portions in the transverse direction, and wherein longitudinally adjacent pairs of overlapped partially cut parts are alternatively shifting in opposite directions to alternatively protrude along the longitudinal direction from one sheet metal portion to the other sheet metal portion producing a plurality of said cuts located directly side by side to define a portion of a seam line such that gaps are absent between the plurality of said cuts located directly side by side.

* * * * *